US009657416B2

(12) United States Patent
Hehenberger

(10) Patent No.: US 9,657,416 B2
(45) Date of Patent: May 23, 2017

(54) CIRCULAR WEAVING MACHINE

(71) Applicant: Starlinger & Co Gesellschaft m.b.H., Vienna (AT)

(72) Inventor: Reinhold Hehenberger, Perchtoldsdorf (AT)

(73) Assignee: STARLINGER & CO GESELLSCHAFT M.B.H., Vienna (AT)

( * ) Notice: Subject to any disclaimer, the term of this patent is extended or adjusted under 35 U.S.C. 154(b) by 0 days.

(21) Appl. No.: 14/907,146

(22) PCT Filed: Jul. 8, 2014

(86) PCT No.: PCT/EP2014/064539
§ 371 (c)(1),
(2) Date: Jan. 22, 2016

(87) PCT Pub. No.: WO2015/010889
PCT Pub. Date: Jan. 29, 2015

(65) Prior Publication Data

US 2016/0160409 A1 Jun. 9, 2016

(30) Foreign Application Priority Data

Jul. 24, 2013 (EP) ..... 13177863

(51) Int. Cl.
*D03D 37/00* (2006.01)
*D03D 51/34* (2006.01)
*D03D 25/00* (2006.01)

(52) U.S. Cl.
CPC ..... *D03D 37/00* (2013.01); *D03D 51/34* (2013.01)

(58) Field of Classification Search
CPC ..... D03D 37/00
See application file for complete search history.

(56) References Cited

U.S. PATENT DOCUMENTS 1,947,976 A * 2/1934 Dickie ..... D03D 37/00 139/457
3,815,643 A * 6/1974 Haoya ..... D03C 13/00 139/15

(Continued)

FOREIGN PATENT DOCUMENTS

CN 102817162 A 12/2012
EP 0167831 A1 1/1986

(Continued)

OTHER PUBLICATIONS

Written Opinion of PCT/EP2014/064539, filed Jul. 8, 2014.

(Continued)

*Primary Examiner* — Bobby Muromoto, Jr.
(74) *Attorney, Agent, or Firm* — Workman Nydegger

(57) ABSTRACT

A circular weaving machine has warp-tape guide elements arranged around a circular reed to supply a multiplicity of warp tapes. Weaving-shed forming devices group the fed warp tapes into two warp-tape groups and impart thereon mutually opposed alternating movements, with the result that a weaving shed is opened and closed between the two warp-tape groups. A weaving shuttle moves on an orbit in the opened weaving shed and, in the process, introduces a weft tape from a weft-tape bobbin carried thereby into the weaving shed, with the result that a fabric is formed. The fabric is drawn off through a weaving ring. The weaving shuttle keeps the bobbin axis of the weft-tape bobbin at an angular position which deviates by at most +/−15°, preferably at most +/−10°, from a normal to a surface which contains the geometric connecting lines between the warp-tape guide elements and the weaving ring.

9 Claims, 3 Drawing Sheets

(56) References Cited

U.S. PATENT DOCUMENTS 3,875,973 A * 4/1975 Kallmeyer ..... D03D 37/00 139/16
4,355,666 A * 10/1982 Torii ..... D03D 51/40 139/457
4,424,836 A * 1/1984 Torii ..... D03D 37/00 139/110
4,432,397 A * 2/1984 Cacciapuoti ..... D03D 37/00 139/458
4,479,517 A * 10/1984 Plammer ..... D03D 37/00 139/436
4,619,293 A * 10/1986 Huemer ..... D03D 49/62 139/457
4,776,371 A * 10/1988 Schonberger ..... D03D 37/00 139/458
4,821,778 A * 4/1989 Zacek ..... D03D 37/00 139/457
4,977,933 A * 12/1990 Brais ..... D03D 37/00 139/15
5,099,891 A * 3/1992 Hiramatsu ..... D03D 37/00 139/457
5,293,906 A * 3/1994 Amin ..... D03D 37/00 139/309
5,787,938 A * 8/1998 Starlinger Huemer D03D 49/20 139/110
5,826,626 A * 10/1998 Huemer ..... D03D 51/34 112/273
7,926,517 B2 * 4/2011 Horimoto ..... D03D 3/02 138/123
8,082,761 B2 * 12/2011 Wang ..... D03D 25/005 66/1 R
2006/0162954 A1 * 7/2006 Horimoto ..... D03D 3/02 174/204
2009/0126823 A1 * 5/2009 Yengkhom ..... D03D 3/02 139/450
2011/0014403 A1 * 1/2011 Wang ..... D03D 25/005 428/34.1
2016/0160409 A1 * 6/2016 Hehenberger ..... D03D 51/34 139/459

FOREIGN PATENT DOCUMENTS

EP 0786026 B1 8/1998
GB 2036813 A 7/1980
KR 20010037753 A 5/2001

OTHER PUBLICATIONS

International Search Report of PCT/EP2014/064539, dated Sep. 16, 2014, filed Jul. 8, 2014.
IPRP of PCT/EP2014/064539, dated Aug. 18, 2015, filed Jul. 8, 2014.
IPRP of PCT/EP2014/064539, dated Jan. 28, 2016, filed Jul. 8, 2014.

* cited by examiner

CIRCULAR WEAVING MACHINE

The present application is a U.S. National Stage of International Application No. PCT/EP2014/064539, filed on Jul. 8, 2014, designating the United States and claiming the priority of European Patent Application No. 13177863.1 filed with the European Patent Office on Jul. 24, 2013. All of the aforementioned applications are incorporated herein in their respective entireties by this reference.

The invention relates to a circular weaving machine.

Circular weaving machines are generally known in which warp-tape guide elements, e.g., in the form of length adjustment compensators, are arranged around the circular reed of the circular weaving machine. Via those warp-tape guide elements or through them, a large number of warp tapes are supplied to the circular weaving machine in a circumferentially distributed fashion. From the warp-tape guide elements, the warp tapes run toward shed forming devices which comprise, for example, laces or bands provided with eyelets for passing through one warp tape at a time; subsequently, the warp tapes run through between bars of the circular reed. At the shed forming devices, the warp tapes are divided—in most cases in an alternating arrangement—into two warp-tape groups onto which mutually opposed alternating movements are imparted through an opposed movement of the laces or eyelet bands, with the result that the weaving shed (also referred to as a moving shed) is opened and closed. In the opened state, the weaving shed forms a space defined by the two warp-tape groups, in which a weaving shuttle carrying a weft-tape bobbin moves on an orbit along the circular reed and, in the process, draws off the weft tape from the weft-tape bobbin it carries, introducing it into the weaving shed. The size of the space of the weaving shed as defined by the two warp-tape groups changes constantly with the movement of the two warp-tape groups, starting from zero with a closed weaving shed in a position in which both warp-tape groups are located in the same surface, up to a maximum at which the two warp-tape groups are located at opposing reversal points of their alternating movement. At those reversal points, the so-called shed change starts by reversing the movement imparted to the opposed warp-tape groups, whereby the last introduced weft tape is fixed in the fabric and the next weft tape can be introduced into the weaving shed by the next shuttle. Usually, several weaving shuttles circulate in the circular reed at equal distances from each other. The produced tubular fabric is guided inwards toward a centrally arranged weaving ring, where it is deflected toward drawing-off rolls.

Such a circular weaving machine is known, for example, from EP 0 786 026 B1.

There has always been the need to enhance the performance of circular weaving machines. The overall performance of the circular weaving machine is significantly influenced by the so-called weft count, which is the number of weft tapes which can be introduced into the weaving shed per unit of time. The weft count is usually indicated in "picks per minute". In the past, the weft count was increased by increasing the rotational speed of the shuttles in the circular reed and/or by increasing the number of shuttles. For example, in EP0167831A1, an increase in the rotational speed has been achieved by specifically designing the tracks on which the pairs of supporting rolls of the weaving shuttles run in the reed. Those specifically designed tracks have increased the smoothness of running of the weaving shuttles, resulting in less wear of the reed, thus allowing a higher rotational speed.

In the meantime, however, the performance limits of circular weaving machines have been reached, with the limiting factor being especially the resilience of structural elements upon which the centrifugal force of the weaving shuttles acts. In particular the guide elements on which the weaving shuttles run along the reed are strained and worn by the centrifugal force of the rotating weaving shuttles. The centrifugal force depends primarily on the mass of the weaving shuttles, the rotational speed (or the number of revolutions, respectively) and the reed's radius. With each increase in individual parameters, the centrifugal force and thus the strain and wear of the structural elements is increased.

Although the load capacity of structural elements onto which the centrifugal force acts is seemingly exhausted by the increase in the number of shuttles and in the speed of the main shaft driving the shuttles as well as the reduction in the weaving shuttle mass, an increase in the weft count of circular weaving machines is still endeavoured in the industry.

It is thus the object of the invention to increase the weft count of circular weaving machines without increasing the strain and wear of the structural elements as a result of the centrifugal force exerted by the rotating weaving shuttles, but, on the contrary, even with a decrease thereof.

The present invention achieves this objective by providing a circular weaving machine having the features of claim 1. Preferred embodiments of the invention are described in the subclaims.

The circular weaving machine according to the invention comprises:

- warp-tape guide elements which are arranged around a circular reed of the circular weaving machine in order to supply a multiplicity of warp tapes to the circular weaving machine;
- weaving-shed forming devices which divide the supplied warp tapes into two warp-tape groups and impart mutually opposed alternating movements to the two warp-tape groups, with the result that a weaving shed is opened and closed between the two warp-tape groups;
- a weaving shuttle which moves on an orbit in the opened weaving shed and, during its circulation, draws off a weft tape from a weft-tape bobbin it carries, introducing it into the weaving shed, with the result that a fabric is formed; and
- a weaving ring through which the fabric is drawn off;
- the weaving shuttle keeping the bobbin axis of the weft-tape bobbin at an angular position which deviates by at most +/−15°, preferably at most +/−10°, from a normal to a surface which contains the geometric connecting lines between the warp-tape guide elements and the weaving ring.

With the loom in operation, the surface which contains the geometric connecting lines between the warp-tape guide elements and the weaving ring corresponds to the surface which is formed jointly by the two warp-tape groups if the weaving shed is closed. Furthermore, in a preferred arrangement of the warp-tape guide elements, the geometric connecting lines are arranged radially between the warp-tape guide elements and the weaving ring.

In comparison to conventional circular weaving machines in which the bobbin axis of the weft-tape bobbin is kept essentially horizontal by the weaving shuttle, the overall length of the weaving shuttle and hence its mass can be reduced by arranging the bobbin axis of the weft-tape bobbin, according to the invention, at an angular position which deviates by at most +/−15°, preferably at most +/−10°, from a normal to the surface of the closed weaving shed, which in turn allows a larger number of weaving shuttles to be provided, with the reed radius being the same. The larger number of weaving shuttles allows a reduction in the rotational speed of the shuttles, whereby, in total, the weft count of the circular weaving machine is increased over the prior art, without the (centrifugal) forces acting on the structural elements strained by centrifugal forces, such as shuttle rolls, circular reed etc., being increased.

An optimization of the above-mentioned advantages of the circular weaving machine according to the invention over conventional circular weaving machines is achieved if the weaving shuttle keeps the bobbin axis of the weft-tape bobbin essentially at right angles to the surface containing the geometric connecting lines between the warp-tape guide elements and the weaving ring.

In one embodiment of the circular weaving machine according to the invention, said surface forms essentially a circular ring surface.

In an alternative embodiment of the circular weaving machine according to the invention, said surface forms essentially a truncated cone surface the axis of which is the machine axis.

In order to be able to guide a weft-tape bobbin through the weaving shed in such a way that, at an angular position which deviates by at most +/−15°, preferably at most +/−10°, from a normal to the surface containing the geometric connecting lines between the warp-tape guide elements and the weaving ring, the bobbin axis thereof is most preferably essentially orthogonal to said surface, a suitable bobbin form has to be chosen. In comparison to weft-tape bobbin of the same total tape length, which are used in conventional circular weaving machines, it is suggested that the bobbin length (frequently also referred to as the traverse width) is reduced in the weft-tape bobbin intended for use in the circular weaving machine according to the invention and the bobbin diameter is increased. A weft-tape bobbin is recommended in which, in the full state, the bobbin diameter is larger than the bobbin length, whereby the available space in the weaving shed can be utilized optimally. Because of this bobbin form according to the invention, the mass of the bobbin is reduced and an additional reduction in the weaving shuttle mass (dead weight, empty weight) is achieved. The respective weight reductions of the bobbin and of the weaving shuttle result in a significant reduction in the centrifugal force acting on the structural elements during the rotation of the weaving shuttles.

Due to the suggested bobbin form, it is possible to reduce the required shed travel (the distance between the reversal points of the two warp-tape groups) and to decrease the transverse acceleration of the warp tapes during the shed change, resulting in a reduced strain on the weaving-shed forming devices.

Furthermore, the compensation distance of warp-tape length adjustment compensators between an opened and a closed weaving shed is reduced due to the shorter shed travel, whereby the differences in the tape tensions acting on the warp tapes between the opened and the closed weaving shed of the warp tapes are reduced and thus the strain on the warp tapes and the compensators is reduced as well.

The invention is now illustrated in further detail on the basis of exemplary embodiments with reference to the drawings. In the drawings.

Figure 1:
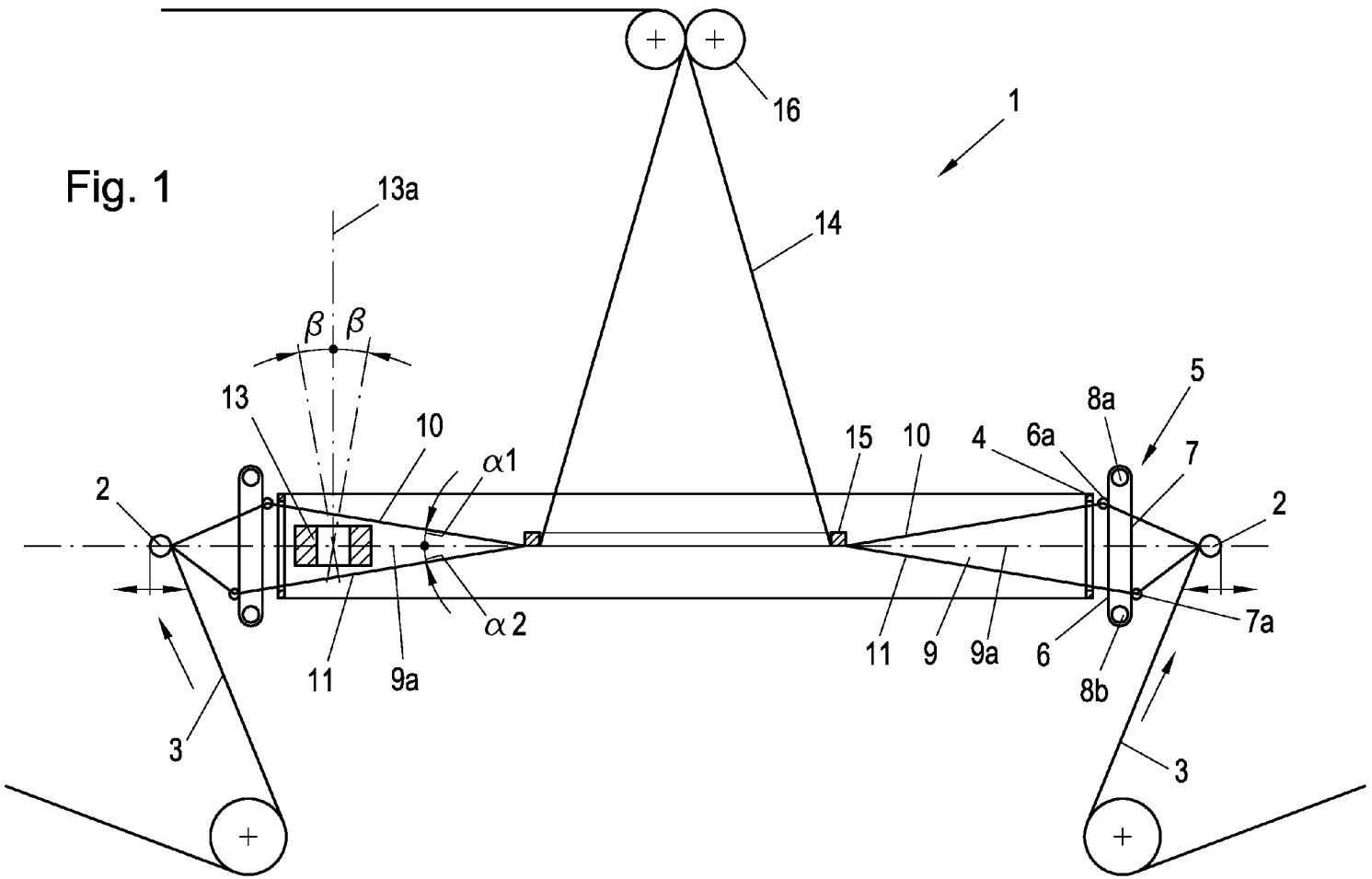
FIG. 1 shows a schematic sectional view of a first embodiment of a circular weaving machine according to the invention.
Figure 2:
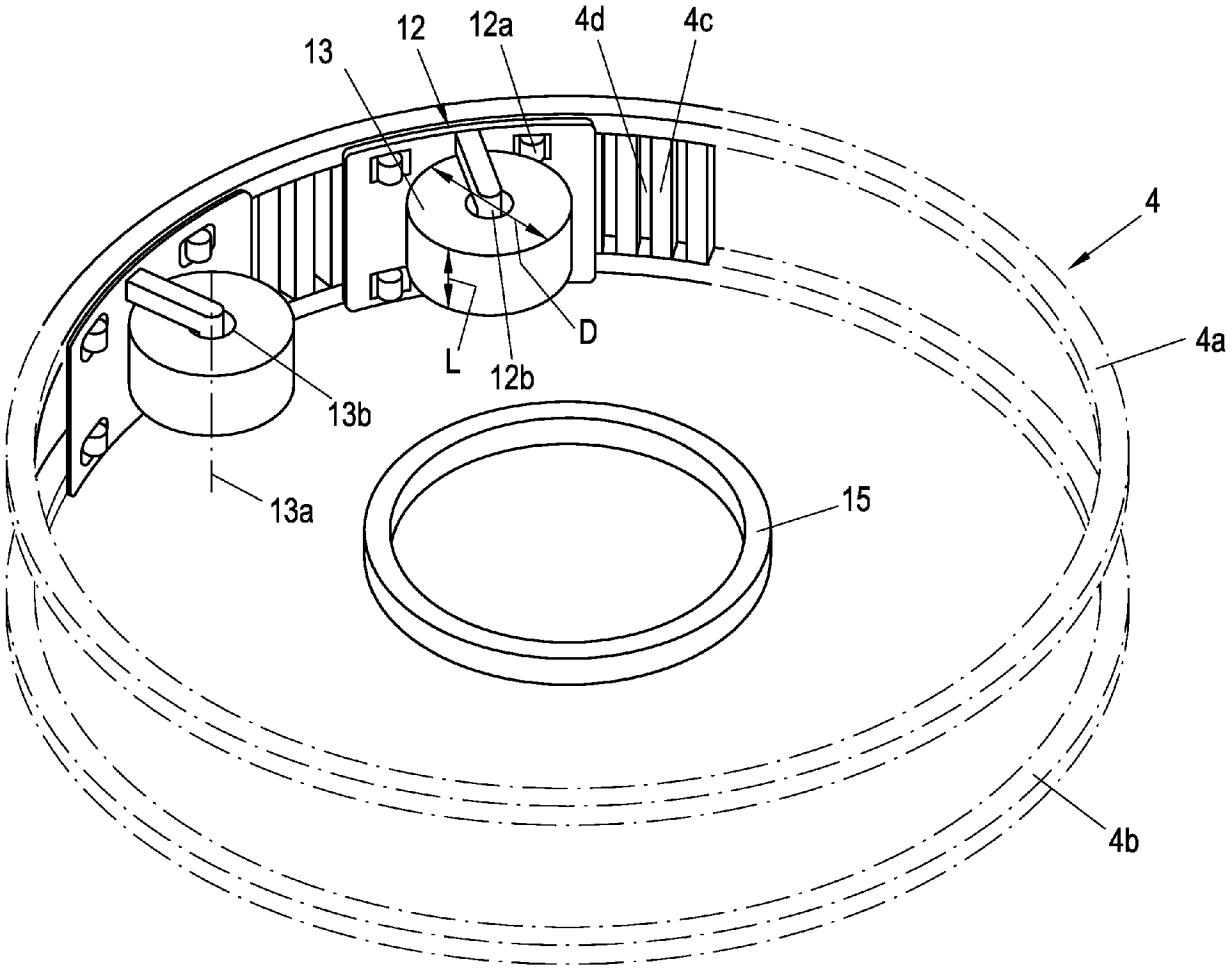
FIG. 2 shows a schematic perspective view of the circular reed and of the weaving shuttles of the circular weaving machine of FIG. 1, which circulate in the circular reed.

For the sake of better clarity, FIG. 1 and FIG. 2 schematically show, in a manner not true to scale, the elements of a first embodiment of a circular weaving machine 1 according to the invention which are essential to the invention. The circular weaving machine 1 comprises a plurality of warp-tape guide elements 2 which are configured as length adjustment compensators and, in each case, comprise a spring bar and an eyelet at the upper end of the spring bar for passing through and deflecting a warp tape 3. The warp-tape guide elements 2 are arranged around the circular reed 4 of the circular weaving machine 1 in a distributed fashion. The circular reed 4 comprises an upper collar 4*a* and a lower collar 4*b* between which a plurality of reed bars 4*c* with clearances 4*d* between adjacent reed bars 4*c* are arranged in an equally distributed fashion. The warp tapes 3 are passed through the warp-tape guide elements 2 by warp-tape bobbin, which are not illustrated, and are passed along through the clearances 4*d* between the reed bars 4*c*.

Between the warp-tape guide elements 2 and the circular reed 4, shed forming devices 5 are arranged around the circular reed 4 in a distributed fashion. The shed forming devices 5 comprise a plurality of first laces 6 and a plurality of second laces 7, which are interconnected at their ends and entwine an upper roll 8*a* as well as a lower roll 8*b*. Each of the first laces 6 has an eyelet 6*a* through which a warp tape 3 is guided. Said warp tapes passed through the eyelets 6*a* of the first laces 6 form a first warp-tape group 10. Each of the second laces 7 has an eyelet 7*a* through which a warp tape 3 is guided. Said warp tapes passed through the eyelets 7*a* of the second laces 7 form a second warp-tape group 11. At least one of the upper roll 8*a* and/or the lower roll 8*b* is rotated alternately into a first and an opposite second direction of rotation, whereby the laces 6, 7 entwining them are moved upwards and downwards in an alternating manner. As a result, a mutually opposed upward and, respectively, downward alternating movement is imparted to the two warp-tape groups 10, 11, with the result that the weaving shed 9 (also referred to as a moving shed) is opened and closed. In the opened state, the weaving shed 9 forms a space defined by the two warp-tape groups 10, 11, in which a weaving shuttle 12 carrying a weft-tape bobbin 13 moves on an orbit along the circular reed 4 and, in the process, draws off a weft tape, which is not illustrated, from the weft-tape bobbin 13 it carries, introducing it into the weaving shed 9. The weaving shed 9 is closed if the laces 6, 7 are located in a central position in which the eyelets 6*a*, 7*a* of the first laces 6 and the second laces 7 are on the same level, whereby both warp-tape groups 10, 11 are located in the same surface 9*a* or, respectively, jointly span said surface 9*a*. In other words, the surface 9*a* of the closed weaving shed 9 is the angle bisector between the first warp-tape group 10, which, in FIG. 1, is the upper warp-tape group, and the second warp-tape group 11, which, in FIG. 2, is the lower warp-tape group. It thus holds true that the angle $\alpha 1$ between the first warp-tape group 10 and the surface 9*a* is equivalent to the angle $\alpha 2$ between the second warp-tape group 10 and the surface 9*a*. At the same time, the surface 9*a* is defined as the surface containing the geometric connecting lines between the warp-tape guide elements 2 and the weaving ring 15.

The size of the space of the weaving shed 9 as defined by the two warp-tape groups 10, 11 changes constantly with the opposing movement of the two warp-tape groups 10, 11, starting from zero with a closed weaving shed. The space of the weaving shed 9 reaches a maximum if the two warp-tape groups 10, 11 are located at the opposite reversal points of their opposing alternating movement, as illustrated in FIG. 1. At those reversal points, the so-called shed change starts by reversing the movement imparted to the opposed warp-tape groups 10, 11. Due to the shed change, the weft tape introduced last into the weaving shed 9 is fixed in the fabric and the next weft tape can be introduced into the weaving shed by the next shuttle 12. As can be seen in FIG. 2, several weaving shuttles 12 circulate in the circular reed 4 at equal distances from each other. The produced tubular fabric 14 is guided inwards toward a centrally arranged weaving ring 15, where it is deflected toward drawing-off rolls 16.

According to the invention, the weaving shuttle 12 keeps the bobbin axis 13*a* of the weft-tape bobbin 13 at an angular position β which deviates by at most +/−15°, preferably at most +/−10°, from a normal to the surface 9*a* of the closed weaving shed 9, using a bobbin holding device 12*b*. In the embodiment of the circular weaving machine according to FIG. 1, the weaving shuttle 12 keeps the bobbin axis 13*a* of the weft-tape bobbin 13 at right angles to the surface 9*a* of the closed weaving shed 9. The surface 9*a* of the closed weaving shed 9 forms a circular ring surface.

The circular weaving machine 1 is designed for the use of plastic tapes as warp tapes and weft tapes, the plastic tapes being elongated for achieving a higher strength. In order that the advantages of the circular weaving machine according to the invention are brought to bear fully, a type of weft-tape bobbin is used which is modified in comparison to conventional weft-tape bobbin in that the bobbin length L is reduced and the bobbin diameter D is increased. In the full condition of the weft-tape bobbin 13, the bobbin diameter D thereof is larger than the bobbin length L, whereby the available space in the weaving shed 9 can be utilized optimally. Because of this bobbin form, the weaving shuttle 12 can be constructed shorter, resulting in a reduction in its mass. As with the recommended bobbin form, the bobbin core 13*b* can be shorter and thus lighter, also the weft-tape bobbin 13 is lighter. The respective weight reductions of the bobbin 13 and of the weaving shuttle 12 result in a significant reduction in the centrifugal force acting on the supporting rolls 12*a*, the circular reed 4 and other structural elements during the rotation of the weaving shuttles 12.

Due to the suggested bobbin form, it is possible to reduce the required shed travel, resulting in a shortening of the reed bars 4*c*. In contrast to longer reed bars, shorter reed bars 4*c* will produce less noise caused by vibrations of the bars. A further noise reduction can be achieved by reducing the number of revolutions and the lower rotational speed of the weaving shuttles 12. A further advantage of the new bobbin form, in comparison to long bobbin of small diameters, is the lesser volume loss via the bobbin core relative to the total volume of the bobbin.

Because of the higher weft count of the described circular weaving machine 1, a smaller number of looms are required for the same output of fabric, which reduces the required space at the manufacturing facilities.

The following table shows a comparison of relevant technical data of a conventional type FX circular weaving machine of the applicant to those of the circular weaving machine according to the invention.

| | prior art | invention |
|---|---|---|
| Weft count [picks per minute] | <1200 ppm | >1200 ppm |
| No. of shuttles | 6 | 10 |
| Shuttle weight | >5 kg | <3 kg |
| Centrifugal force | 1300 N | 300 N |
| Shed travel | 160 mm | ≤100 mm |
| Compensation distance | >13 mm | <4 mm |

Figure 3:
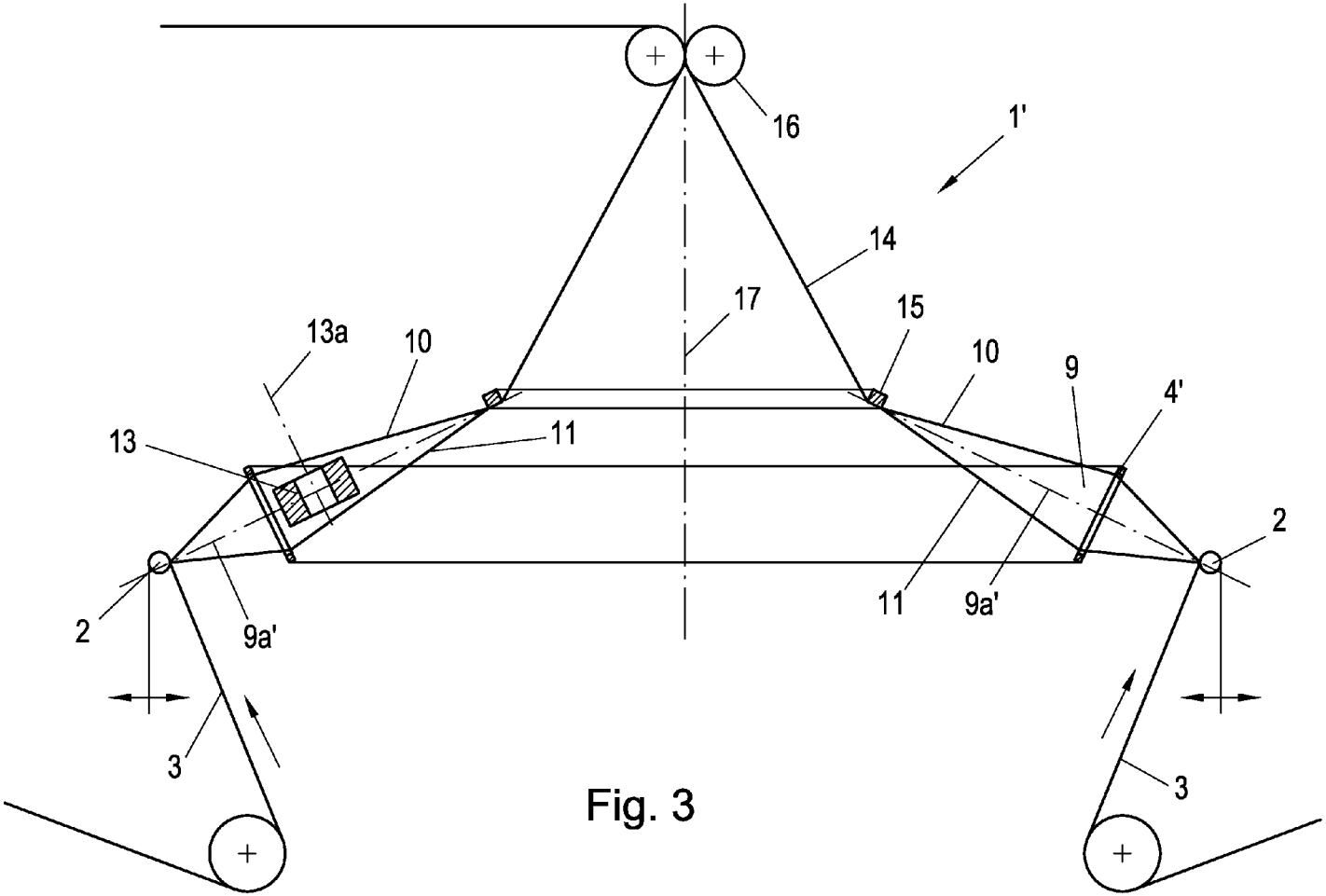
FIG. 3 shows a schematic sectional view of a second embodiment of a circular weaving machine according to the invention.

FIG. 3 schematically shows a side view of a second embodiment of a circular weaving machine 1' according to the invention. Said second embodiment of the circular weaving machine 1' differs from the first embodiment shown in FIGS. 1 and 2 only in that the weaving ring 15 is positioned higher than the warp-tape guide elements 2, whereby the course of the first warp-tape group 10 and the second warp-tape group 11 is inclined obliquely upwards toward the central machine axis 17. For this reason, the weaving shed 9 is also inclined accordingly. The result is that the surface 9*a'* of the closed weaving shed 9 forms a truncated cone surface with the machine axis 17 as the truncated cone axis. In this exemplary embodiment, also the circular reed 4' is designed as an upwardly expanding truncated cone. The remaining components of the circular weaving machine 1' in the second embodiment thereof correspond to those of the first embodiment and are indicated by the same reference characters. As for a description of those components, reference is made to the above explanations.

The invention claimed is:

1. A circular weaving machine comprising warp-tape guide elements which are arranged around a circular reed of the circular weaving machine in order to supply a multiplicity of warp tapes to the circular weaving machine, comprising weaving-shed forming devices which divide the supplied warp tapes into two warp-tape groups and impart mutually opposed alternating movements to the two warp-tape groups, with the result that a weaving shed is opened and closed between the two warp-tape groups, comprising a weaving shuttle which moves on an orbit in the opened weaving shed in order to draw off, during its circulation, a weft tape from a weft-tape bobbin it carries, introducing it into the weaving shed, with the result that a fabric is formed, and comprising a weaving ring through which the fabric is drawn off, wherein the weaving shuttle keeps the bobbin axis of the weft-tape bobbin at an angular position which deviates by at most +/−15°, from a normal to a surface which contains the geometric connecting lines between the warp-tape guide elements and the weaving ring.

2. A circular weaving machine according to claim 1, wherein the weaving shuttle keeps the bobbin axis of the weft-tape bobbin essentially at right angles to the surface.

3. A circular weaving machine according to claim 1, wherein the surface forms essentially a circular ring surface.

4. A circular weaving machine according to claim 3, wherein the circular reed is configured as a circular cylinder.

5. A circular weaving machine according to claim 1, wherein the surface forms essentially a truncated cone surface.

6. A circular weaving machine according to claim 5, wherein the circular reed is configured as a truncated cone.

7. A circular weaving machine according to claim 1, wherein the weaving ring is arranged inside the circular reed.

8. A weft-tape bobbin in a circular weaving machine according to claim 1, wherein, with the weft-tape bobbin being full, the bobbin diameter (D) is larger than the bobbin length (L).

9. A weft-tape bobbin according to claim 8, wherein the weft-tape bobbin is a bobbin with plastic tapes wound around it.

* * * * *